United States Patent [19]

Bertini et al.

[11] Patent Number: 4,549,780

[45] Date of Patent: Oct. 29, 1985

[54] ELECTRICAL CONNECTOR WITH ALTERNATIVE CABLE EXITS

[75] Inventors: Carlo Bertini; Aldo Bruni, both of Turin, Italy

[73] Assignee: AMP Incorporated, Harrisburg, Pa.

[21] Appl. No.: 635,075

[22] Filed: Jul. 27, 1984

[51] Int. Cl.[4] ..... H01R 13/595

[52] U.S. Cl. ..... 339/107; 339/103 M

[58] Field of Search ..... 339/103 R, 103 M, 107, 339/210 RM

[56] References Cited

U.S. PATENT DOCUMENTS

| | | | |
|---|---|---|---|
| 3,622,943 | 11/1971 | Reimer | 339/103 M |
| 3,794,960 | 2/1974 | Sugar | 339/107 |
| 3,904,265 | 9/1975 | Hollyday et al. | 339/103 M |
| 4,421,376 | 12/1983 | Cosmos et al. | 339/103 M |

FOREIGN PATENT DOCUMENTS

| | | | |
|---|---|---|---|
| 0059566 | 2/1982 | European Pat. Off. . | |
| 929908 | 7/1955 | Fed. Rep. of Germany | 339/103 R |

*Primary Examiner*—Eugene F. Desmond

*Attorney, Agent, or Firm*—Robert W. J. Usher

[57] ABSTRACT

An electrical connector housing assembly in which a housing shell (11, 11') is formed with a pair of spaced cable lead out openings (22, 22'; 23, 23') having axes inclined at an angle to each other. A plug member (34) is provided with adjustable cable clamping means (41, 44) and is receivable in either lead out opening (22, 22'; 23, 23') with the line of action of the cable clamping means (41, 44) inclined at an angle with the axis of the lead out opening (22, 22' or 23, 23') in which it is received, complimentary to the angle of inclination of their axes to exert a clamping force perpendicular to the axis of a cable (49) received in the other lead out opening (23, 23' or 22, 22').

6 Claims, 5 Drawing Figures

ELECTRICAL CONNECTOR WITH ALTERNATIVE CABLE EXITS

The invention relates to electrical connector housings which are adapted to enable cable lead out in alternative directions through different exits and clamp the cable to provide strain relief.

There have been various prior proposals for electrical connector housings adapted to enable lead out of the terminated cable in alternative directions.

In one proposal a wall of the housing is formed with spaced apart frangible portions either of which can be selectively removed to provide a cable lead out opening in a desired direction. A disadvantage of this proposal, however, is that a tool is required to fracture the frangible portion and, once fractured, the lead out direction cannot be changed.

In another prior proposal, connector housing parts can be assembled in either of two different orientations on a terminal block from which the cable extends to provide cable lead out openings extending in different directions. However, where cables of different sizes are to be accommodated additional cable clamps must be provided increasing manufacture, storage and assembly costs.

It is an object of the invention to provide a housing assembly which avoids or ameliorates some of the above-mentioned disadvantages.

According to the invention, there is provided an electrical connector housing assembly comprising a body having a terminal receiving face and a cable receiving face remote from the terminal receiving face, the cable receivng face being formed with two spaced apart apertures having axes inclined at an angle to each other to provide cable lead out openings extending in different directions, a plug having adjustable cable clamping means, a cable clamping surface formed in the housing adjacent each opening, the plug being releasably receivable in either lead out opening with the cable clamping means operable to clamp a cable extending through the other opening against the cable clamping surface.

Accordingly, cable lead out in either direction can be obtained simply by insertion of the plug in the appropriate lead out opening and strain relief obtained by adjustment of the cable clamping means to clamp the cable against the cable clamping surface. Thus, a need to remove frangible portions is avoided and the housing can subsequently be reused to provide cable lead out in the other direction. At the same time, effective clamping of cables of different sizes can be obtained and the unused lead out opening sealed by the plug member.

Preferably, the line of action of the cable clamping means is inclined at an angle with the axis of the lead out opening in which it is received which angle is complimentary to the angle of inclination between the lead out openings and the cable clamping surface extends generally parallel to the axes of respective lead out openings on the remote side of the lead out openings.

The plug can therefore be received in respection lead out openings with the line of action of the adjustable clamping means directed in opposite directions perpendicular to the respective axes of the lead out openings effectively to clamp the cable against the associated cable clamping surface.

Conveniently, the adjustable cable clamping means comprises a screw received in a bore in the plug and a cable clamping member is slidably mounted on the plug for extension by the screw into clamping engagement with the cable.

An example of an electrical connector housing according to the invention will now be described with reference to the accompanying drawings in which.

Figures 1, 4A, 4B:
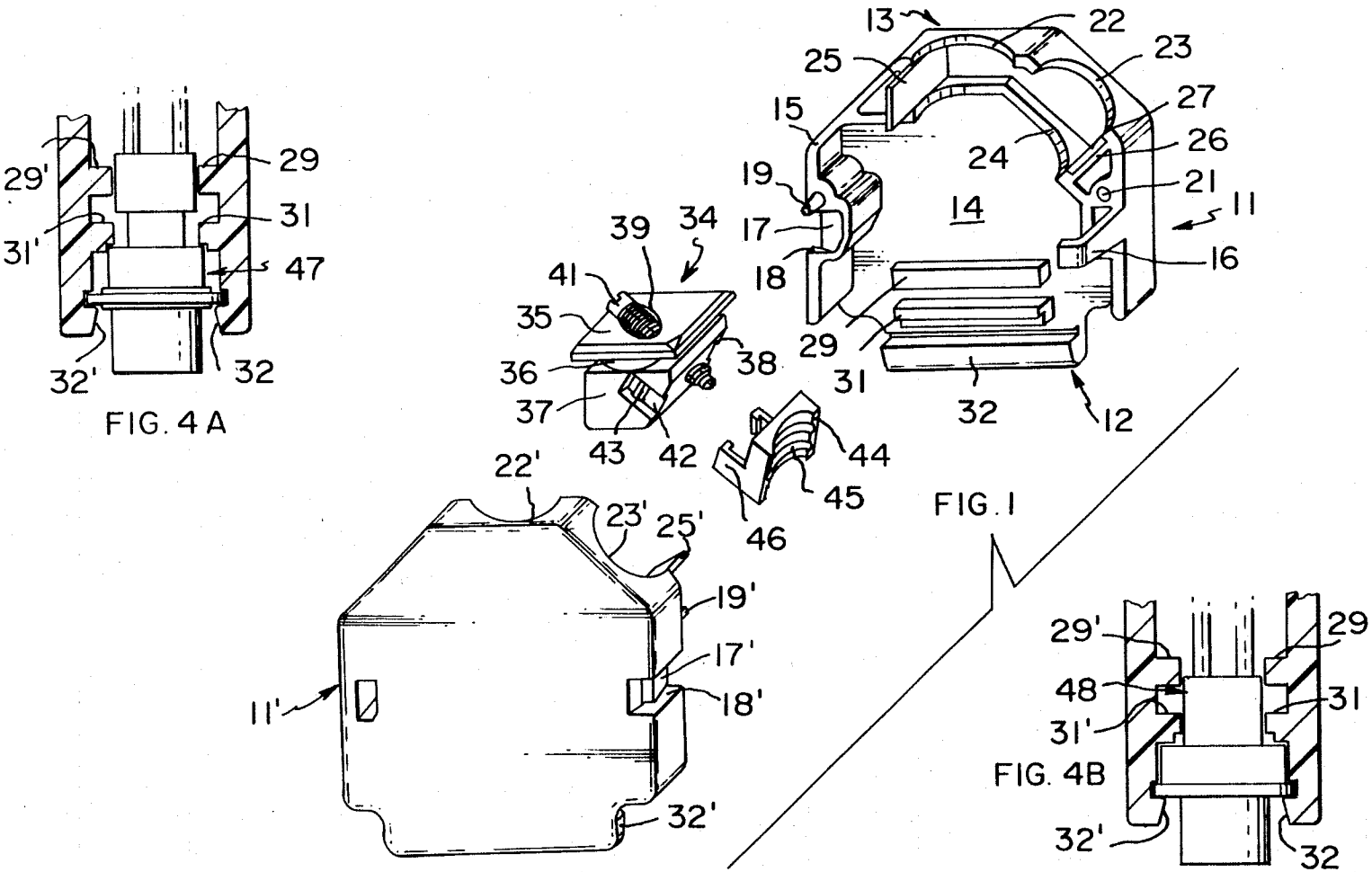
FIG. 1 is an exploded prospective view of the housing.

The electrical connector housing comprises a pair of identical half shells 11, 11' and a plug member 34 having adjustable cable clamping means comprising a cable engaging clamp 44 operated by a screw 41. As the half shells 11, 11' are identical, only one will be described, identical parts on the other being identified by prime reference minerals.

The half shell 11 is moulded from suitable plastics material and comprises a front, mating face 12 and a rear, cable receiving face 13, a base wall 14 and a side wall 15 which upstands from the periphery of the base wall and extends around the periphery of the base wall from opposite ends of the mating face.

A resilient, hooked latching arm 16 upstands from the side wall 15 at one side of the housing 11 and a catch 17 extends across a groove 18 formed in the side wall at the opposite side of the housing, engagement of the catch 17 and latching arm 16 with the corresponding latching arm and catch on the other half shell 11' enabling the half shells 11 and 11' to be releasably secured together. An alignment pin 19 and socket 21 are formed in the side wall adjacent the catch and latching arm for engagement with a corresponding socket and pin on the other half shell 11'.

A pair of semi-circular apertures 22, 23 are formed in the side wall 15 at the rear cable receiving face 13 for cooperation with corresponding apertures 22', 23' on the half shell 11' to define alternative cable lead out openings which have axes inclined at an angle of 45'. Another side wall portion 24 upstands from the base, spaced within the side wall 15 adjacent the cable receiving face and the side walls are joined at locations adjacent and on remote sides of the apertures 22 and 23 by bridging portions 25 and 26, respectively, which extend parallel to the axes of adjacent apertures. The bridging portion 25 is of increased height to provide a cable supporting surface and the bridging portion 26 is provided with a recess 27 for receiving an identical bridging portion 25' of half shell 11' when the half shells 11 and 11' are secured together.

Ribs 29, 31 extend in parallel spaced relation across the base wall 14 adjacent the mating face for cooperation with a lip 32 at a mouth of the mating face and corresponding ribs and lip on the housing shell half 11 to retain either of two commercial types of terminal block 47 or 48 therein.

The plug member 34 is moulded of suitable plastics material and comprises a flat rectangular rear plate portion 35 joined by a cylindrical neck of reduced width to a generally cubic mounting portion 37 having one inclined face 38. The plug member is formed with a threaded bore 39 extending through the plate portion 35 to face 38 having its axes extending at 45° to the axis of the plug member and receiving a clamping screw 41. Opposite sides of the mounting portion 37 are formed with blind ended grooves 42 having transverse catches 43. A clamping member 44 is formed with a ridged cable engaging face 45 and a pair of hooked locating arms 46 extending in spaced relation from opposite sides for limiting sliding movement along grooves 42 between the blind end and the catch 43 by adjustment of clamping screw 39.

Figure 2:
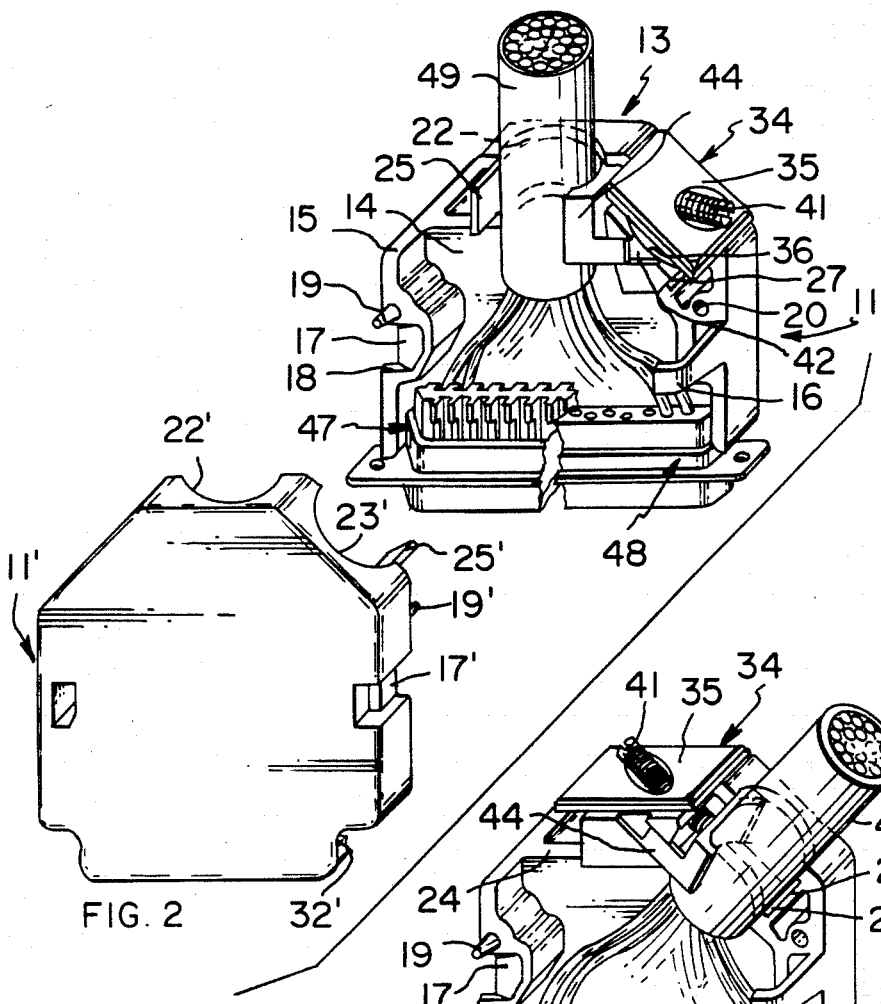
FIG. 2 is a perspective view of the housing arranged to provide cable lead out perpendicular to a mating face and with a housing half shell raised for clarity.

In assembling the connector housing to provide cable lead out perpendicular to the mating face 12 as shown in FIG. 2, either of two well known terminal blocks, 47 or 48 commerically known as HDE connectors and HD 20 connectors, respectively, are located in half shell 11 (as shown in FIGS. 4A and 4B, respectively) with cable 49 terminated by terminals in the blocks extending through aperture 22. The plug member 35 is located in aperture 23 with the edge of the aperture 23 seated against neck 36 and with the cable engaging member 44 located on the block portion 37 with the hooked ends of arms 46 received in grooves 42. The screw 41 may then be partially adjusted to aid cable retention and the other half shell 11' applied to the half shell 11 with guide posts 19 and sockets 20 and on half shell 11 engaging the sockets and guide posts on half shell 11' and interengagement of the latching arms 16, 16' (not shown) and catch 17' and 17. The portions of the cable supporting surfaces 25, 25' of increased height are received in the aligned grooves 25, 25'.

The screw 41 may then be fully tightened to extend the clamping member 44 to fully clamp the cable against the cable supporting surface 25.

Figure 3:
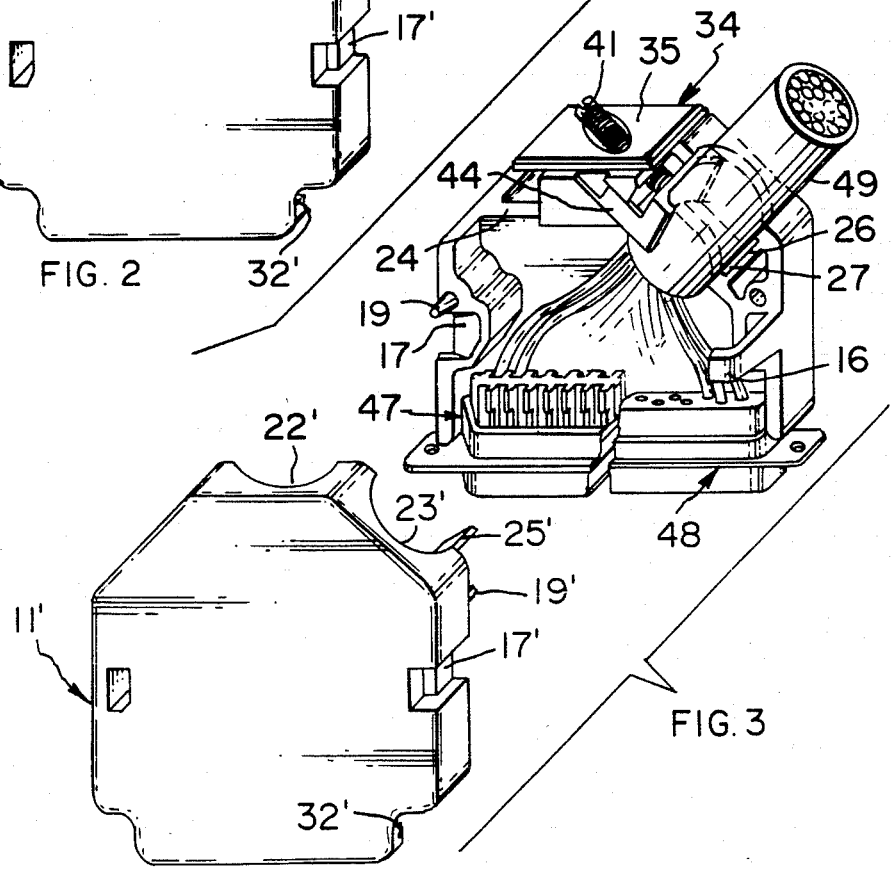
FIG. 3 is a similar view to FIG. 2 but with the housing arranged to provide cable lead out at an angle of 45° to the mating face; and, FIGS. 4A and B are fragmentary cross sectional views of the mating face with different terminal blocks located therein.

The assembly of the cable 49 to provide lead out at an angle of 45° to the mating face (as shown in FIG. 3) may be achieved in a similar fashion but with the plug member 34 inserted in aperture 22 reorientated with the screw extending in an opposite direction.

It should be noted that by chosing the (acute) angle between the line of action of the screw and the axis of the aperture to be the complement of the angle of inclination of the apertures 22 and 23 the line of action of the screw is always perpendicular to the axis of the cable irrespective of the angle of inclination such that maximum effective clamping face can be obtained.

In addition, the connector housing assembly requires only a few separate parts which are relatively easily assembled to provide both effective clamping of cables of different size and cable lead out in different directions. Furthermore, the shape and disposition of the connector block locating ribs 29, 31 and lip 32, 32' enables connector blocks of two different types to be located at the mating surface.

We claim:

1. An electrical connector housing assembly comprising a body having a terminal receiving face and a cable receiving face remote from the terminal receiving face, the cable receiving face being formed with two spaced apart apertures having axes inclined at an angle to each other to provide cable lead out openings extending in different directions, a plug having adjustable cable clamping means, a cable clamping surface formed in the housing adjacent each opening, the plug being releasably receivable in either lead out opening with the cable clamping means operable to clamp a cable extending through the other opening against the cable clamping surface.

2. An electrical connector housing according to claim 1 in which the line of action of the cable clamping means is inclined at an angle with the axis of the lead out opening in which it is received which angle is complimentary to the angle of inclination between the lead out openings and the cable clamping surface extends generally parallel to respective lead out openings on the remote sides of the lead out openings.

3. An electrical connector housing according to claim 2 in which the adjustable cable clamping means comprises a screw received in a bore in the plug.

4. An electrical connector housing according to claim 3 in which a cable clamping member is slidably mounted on the plug for extension by the screw into clamping engagement with the cable.

5. An electrical connector housing according to claim 1 which the body is formed as two identical half shells adapted to be releasably attached together.

6. An electrical connector housing according to claim 1 in which a pair of spaced terminal block locating surfaces are provided adjacent the mating face for selective engagement with alternative terminal blocks of different sizes to secure a chosen terminal block at the mating face.

* * * * *